United States Patent [19]

Blanpain et al.

[11] 4,248,136

[45] Feb. 3, 1981

[54] THRUST DEVICE USING HYDRAULIC JACKS

[75] Inventors: Guy Blanpain, Verneuil en Halatte; Pierre Grandfils, Précy-sur-Oise, both of France

[73] Assignee: Charbonnages de France, Paris, France

[21] Appl. No.: 931,729

[22] Filed: Aug. 7, 1978

[30] Foreign Application Priority Data

Aug. 18, 1977 [FR] France ..... 77 25269

[51] Int. Cl.[3] ..... F01L 25/06; F01B 7/18

[52] U.S. Cl. ..... 91/305; 91/313; 91/321

[58] Field of Search ..... 91/305, 306, 313, 321

[56] References Cited

U.S. PATENT DOCUMENTS

| | | | |
|---|---|---|---|
| 1,987,003 | 1/1935 | Dole | 91/305 |
| 2,890,658 | 6/1959 | Hjarpe | 91/305 |
| 3,225,663 | 12/1965 | Pelisson | 91/305 |

FOREIGN PATENT DOCUMENTS

| | | |
|---|---|---|
| 1910107 | 9/1970 | Fed. Rep. of Germany . |
| 959904 | 4/1950 | France . |
| 2056312 | 5/1971 | France . |
| 1303452 | 1/1973 | United Kingdom . |

*Primary Examiner*—Paul E. Maslousky

*Attorney, Agent, or Firm*—Cushman, Darby & Cushman

[57] ABSTRACT

The invention relates to a thrust device using a plurality of hydraulic jacks, and to the automatic control of a plurality of thrust jacks.

Two differential jacks have resetting chambers which are permanently under hydraulic pressure. Associated with each jack there is a self-locking piloted valve placed in the active position by a push-rod at the end of a work stroke of the piston of the jack and restored into the inactive position by a piloted valve actuated by a push-rod 39 at the end of the return stroke of the piston to its starting position. In the active position the self-locking piloted valve controls the isolation from the supply of all the work chambers and the venting of the associated work chamber 14.

5 Claims, 3 Drawing Figures

THRUST DEVICE USING HYDRAULIC JACKS

BACKGROUND OF THE INVENTION

The invention relates to an at least quasi-continuous thrust device using a plurality of hydraulic jacks.

In certain technical applications, more particularly in mining, there is a need to thrust an object or to haul a machine or a support by means of a plurality of jacks. One example of thrusting by means of a plurality of jacks, is the scraping of armoured conveyors along a coal, or other mineral, cutting face, which necessitates a large number of thrust jacks. The moving forward of support piers, either by shifting jacks or by ratchet jacks included in the pier itself, may also be mentioned. Descriptions of such a pier may be found in the Applicant's United States Patent Application Ser. No. 858,064 filed Dec. 6, 1977 now U.S. Pat. No. 4,114,385.

In every application where a plurality of thrust jacks is used, there is a problem of returning to the starting position of the jack which is at the end of its thrust stroke. In practice, this operation necessitates a large number of manual operations which were difficult to co-ordinate. When a jack is at the end of its stroke, it must be reset while the other jack or jacks are locked.

A main object of the invention is to eliminate the manual operations by subordinating the operations to one another, thus permitting a total automation of the thrust.

SUMMARY

The invention provides a quasi-continuous thrust device using a plurality of hydraulic jacks, the work chambers of which are normally supplied in parallel each by a pressurised hydraulic fluid supply pipe fed by a hydraulic compressor, and which has controlled means for closing the supply pipes, and controlled venting means for the work chambers. The jacks are double-acting jacks each comprising a piston, having a work face defining the work chamber and a resetting face defining a resetting chamber, and capable of moving to-and-fro between a starting position and an end-of-work stroke position.

Associated with each jack there are a bistable pilot device the placing of which in the active pilot position is tripped by the arrival of the piston of the jack at its end-of-work stroke position, and a device operable on the return of the piston to its starting position to control the return of the bistable pilot device to the inactive position. Means responsive to the active position of the bistable pilot device controls the venting of the work chamber of the associated jack and the closure of the controlled closure means in the supply pipes of the work chambers, and means associated with the supply of pressurised hydraulic fluid to each of the resetting chambers are operable at least while the associated pilot device is in its active position.

In one embodiment, each jack is a differential jack, the work face of the piston of which is of greater area than its resetting face, and each resetting chamber is permanently supplied by the associated pressurised hydraulic fluid supply means.

The pressurised hydraulic fluid supply means for each resetting chamber may be responsive to the active pilot position of the associated bistable pilot device.

BRIEF DESCRIPTION OF THE DRAWINGS

Some embodiments of the invention will now be described, by way of example, with reference to the accompanying drawings in which.

DESCRIPTION OF THE PREFERRED EMBODIMENTS

Figure 1:
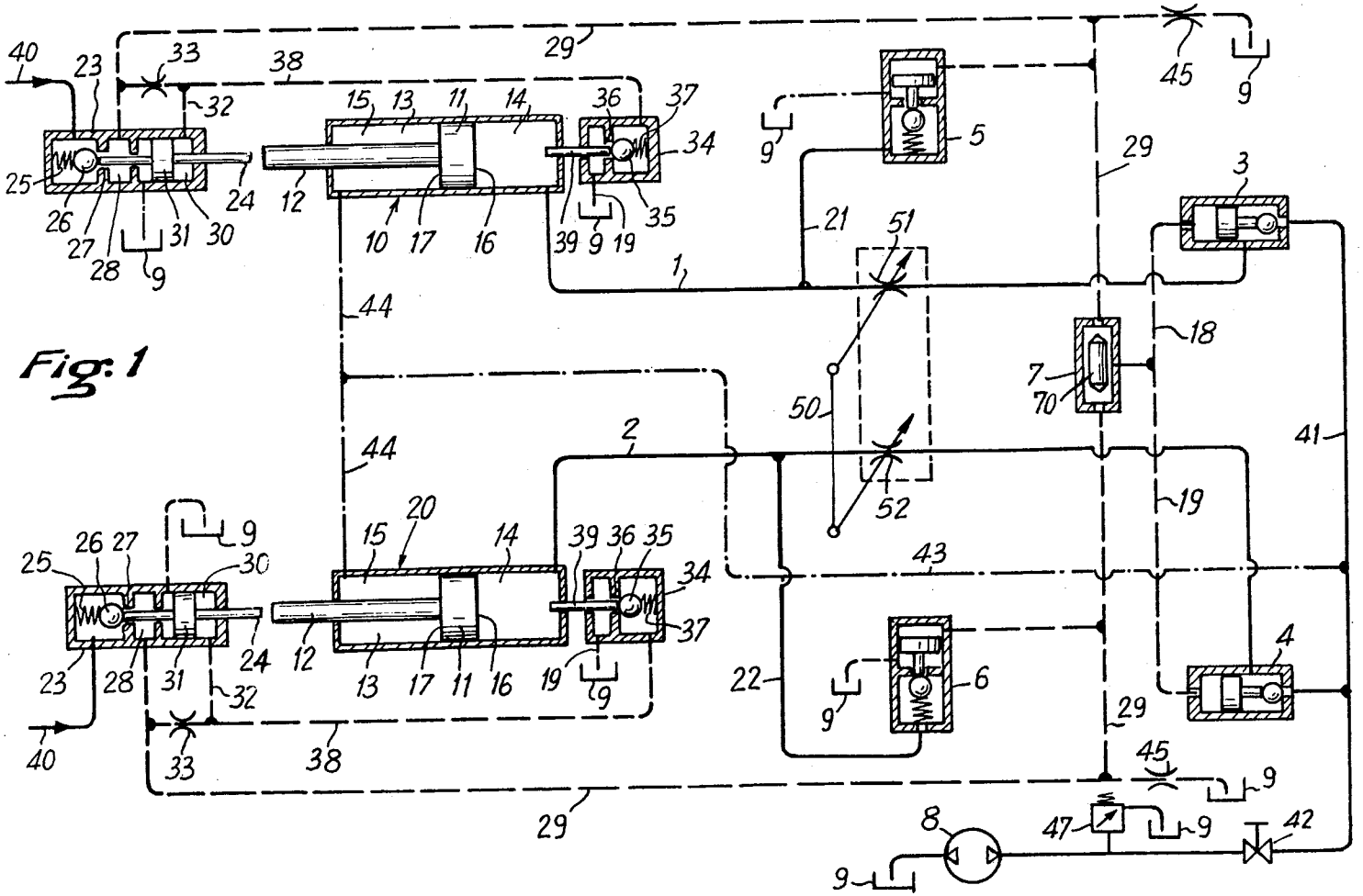
FIG. 1 shows the diagram of a thrust device with two jacks according to the invention.

FIG. 1 illustrates diagrammatically a quasi-continuous hydraulic thrust device with two jacks, according to the invention.

Two double-acting jacks 10 and 20 are provided to thrust from a starting position, the farthest right as shown in the figure, to an end-of-work stroke position which is the farthest left in the figure. These jacks are identical, each comprising a piston 11 with which a jack rod 12 is associated. The piston delimits, in the cylinder 13 of each jack, a work chamber 14 and a resetting chamber 15, and therefore has a work face 16 and a resetting face 17 respectively.

Each of the work chambers 14 is supplied by a pressurised fluid supply pipe, referenced 1 for the chamber 14 of the jack 10, and referenced 2 for the chamber 14 of the jack 20. A hydraulic pump 8, supplied by a tank 9, normally supplies the two pipes 1 and 2 in parallel with pressurised hydraulic fluid, as will be explained below, by means of a main pipe 41, in which a flow regulator valve 42 is installed and to which a pressure regulator 47 is connected. The pipes 1 and 2 are connected to the pipe 41 through piloted valves, respectively 3 and 4. A piloted valve 5 is connected by a branch 21 to the pipe 1, and a piloted valve 6 is connected by a branch 22 to the pipe 2. The valves 5 and 6 vent the work chambers of the jacks 10 and 20.

Associated with the rod 12 of each jack there is a self-locking piloted valve 23 having an active pilot position and a passage position, the latter being that which is illustrated in FIG. 1.

Each piloted valve 23 has a push-rod 24 which moves into the body of the valve progressively as the rod 12 of the jack 10 or 20 moves towards its end-of-work stroke position. When the push-rod 24 attains its extreme position, towards the left in FIG. 1, corresponding to the end-of-work stroke position of the associated piston 11, it pushes a ball 26 which acts as a valve having been applied against a seat 27 by a spring 25 and by hydraulic fluid pressure applied permanently through a pipe 40 into the body of the piloted valve 23. The valve 23 therefore remains in an inactive position so long as the push-rod 24 has not pushed the ball 26 to the left in the figure. On the side of the seat 27 opposite the ball 26, the piloted valve 23 has a pilot chamber 28 to which a pilot pipe 29 is connected. The piloted valve 23 also comprises a locking cylinder 30 in which there moves a piston 31 connected rigidly to the push-rod 24. A pipe 32 connected as a branch to the pipe 29 through a throttle 33 opens into the cylinder 30 on the side which pushes the piston 31 towards its active pilot position.

It will be seen that the piloted valve 23 constitutes a bistable device, the placing of which in the active pilot position is tripped by the arrival of the piston 11 in its end-of-work stroke position and that the valve 23 then remains in the active position, at least as long as the hydraulic pressure is maintained acting on the piston 31, even if the piston 11 leaves its end-of-work stroke position, as shown in the figure.

On the side of the jack 10 or 20 opposite the rod 12, there is a simple piloted valve 34, a ball 35 of which is applied against a seat 36 by a spring 37 and possibly by the hydraulic pressure supplied by a pipe 38 connected to the pipe 32. The ball 35 can be moved away from the seat 36 by a push-rod 39 which responds to the presence of the piston 11 in its starting position. In the open position of the ball valve 35, 36 the pipe 38 is vented through a pipe 19 connected to the body of the valve 34 on the side of the seat 36 opposite to the ball 35.

It will be seen that the return of the piston 11 to its starting position vents the circuit which maintains the piston 31 under pressure and thus unlocks the self-locking piloted valve 23, which then returns to its inactive position.

Finally, the self-locking piloted valve 23 is in the inactive position so long as the jack remains in the starting position and thrusts, but it swings into the active position until the jack reaches its end of stroke, and it remains in that position so long as the jack has not returned to its starting position, then it again springs into the inactive position as soon as the jack has returned into its starting position.

Each pilot pipe 29, which is pressurised when the self-locking piloted valve 23 is in the active position, acts on a simple piloted valve 5 associated with the jack 10, or a similar valve 6 associated with the jack 20. The valve 5 or 6, under the action of the pressure of the pilot circuit 29, vents the pipe 1 or 2 respectively, i.e., the associated work chamber 14 of the jack 10 or 20.

At this moment it is necessary to isolate the supply on the pipe 1 or 2 from the main pipe 41. For this purpose the pipes 1 and 2 are each connected to the main pipe 41 through a piloted valve, 3 and 4 respectively, which shut-off the supply when a pilot pressure appears in one of the pilot pipes 29. The two pipes 29 are connected in opposition to two symmetrical inlets of a circuit selector 7 having a floating block needle 70 and which supplies the two piloted valves 3 and 4 in parallel through pipes 18 and 19. The appearance of a pilot pressure in either of the pilot circuits 29 closes both valves 3 and 4, thus isolating the supply to the jacks 10 and 20. The consequence is that the jack whose pilot circuit is active is vented and can return to its starting position, whereas the other jack is locked immovably until the first has returned to its starting position.

Regulating valves 51 and 52 are interposed in the pipes 1 and 2, to permit the thrusts of the jacks 10 and 20 to be regulated relatively to one another, for example in order to make a machine which these jacks are thrusting execute a turn. A controller 50 enables the regulation to be performed in a single operation.

In the example described in FIG. 1, the two jacks are of the differential type, i.e., the work face 16 of the piston 11 has a greater effective surface than its resetting face 17. This is why the two resetting chambers 15 are supplied permanently with pressurised hydraulic fluid. To this end a pipe 44 leads into each of said chambers, both pipes 44 being branched in parallel from an auxiliary main pipe 43, itself branched from the main pipe 41. In this way any venting of the work chamber 14 causes a return action of the piston by the effect of the permanent pressure in the resetting chamber.

To complete the description of FIG. 1, it should also be mentioned that, in order to limit the consequences of possible leakages, the pilot pipes 29 have calibrated throttles 45 issuing into the tank 9.

Having described the diagram of FIG. 1 in detail, the mode of functioning of the device will now be described briefly.

The forward movement of a machine, or the thrusting of an object, by means of the device is effected by the simultaneous thrust of the two identical double-acting hydraulic jacks 10 and 20. When one of the jacks reaches its end of stroke, it is automatically reversed. If care has been taken, according to usual practice, to make fast either the rod or the jack, e.g., by ratcheting, then the jack retracts without exerting a force upon the machine or the object, i.e. it returns under no-load. During the no-load return of the jack, the other jack is locked hydraulically in position, since its piloted supply valve 3 or 4 is in the closed position. As soon as the first jack has accomplished its return stroke, both jacks are restored to working pressure.

If, exceptionally, both jacks arrive simultaneously at their end of stroke, they are vented simultaneously and restored to working pressure as soon as they have both attained their starting positions.

In all cases a parallel thrust is obtained by balancing the thrust upon the jacks, and a turning thrust is obtained by a differential action upon the jacks by means of the controller 50 acting upon the regulator valves 51 and 52. The controller may also be used by subordinating it automatically to a reference base, e.g., the inclination observed with reference to the face of an object to be thrust.

Figure 2:
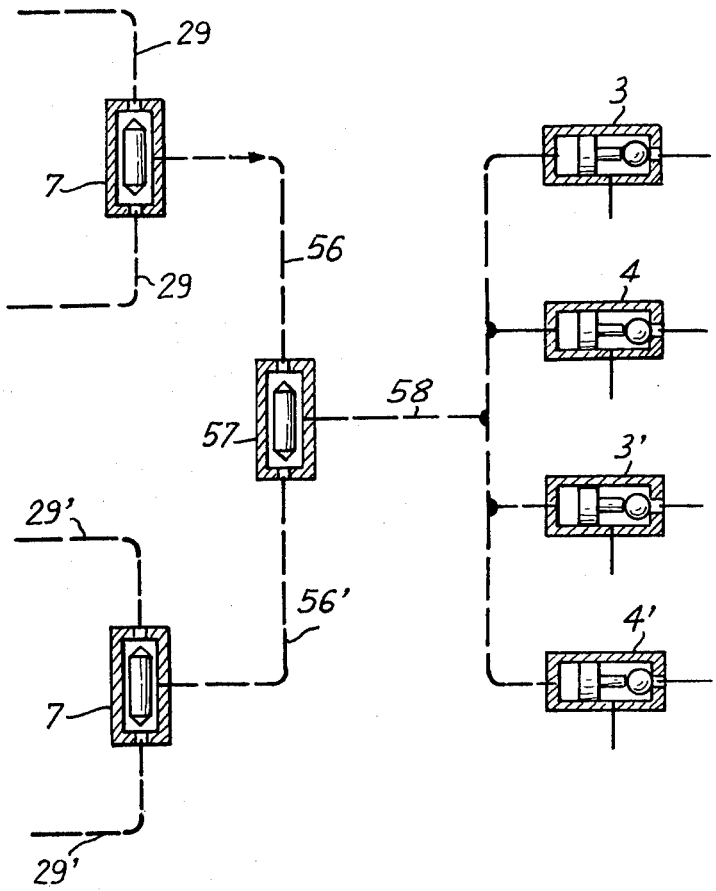
FIG. 2 is a partial diagram of a device according to the invention showing the possibility of using more than two thrust jacks.

FIG. 2 shows how a plurality of two-jack devices may be associated in a device comprising more than two jacks.

In a device with "n" jacks, there are "n" piloted valves 23, 34, 5 or 6, and 3 or 4 and also associated pilot pipes.

The pilot pipes 29 are associated in pairs to pilot a circuit selector 7, e.g., two pipes 29 to pilot a selector 7 and two pipes 29' to pilot a selector 7'. In turn, the selectors 7,7', . . . are associated two-by-two to pilot, through a pipe 56, 56', a selector 57 capable of supplying in parallel then "n" valves 3, 4, 3', 4', . . . by means of a pipe 58. It is thus possible to connect tiers of selectors in cascade. If "n" is not a power of 2, then as appropriate one jack or one or more selectors will be attached to a tier staggered with respect to the others.

Figure 3:
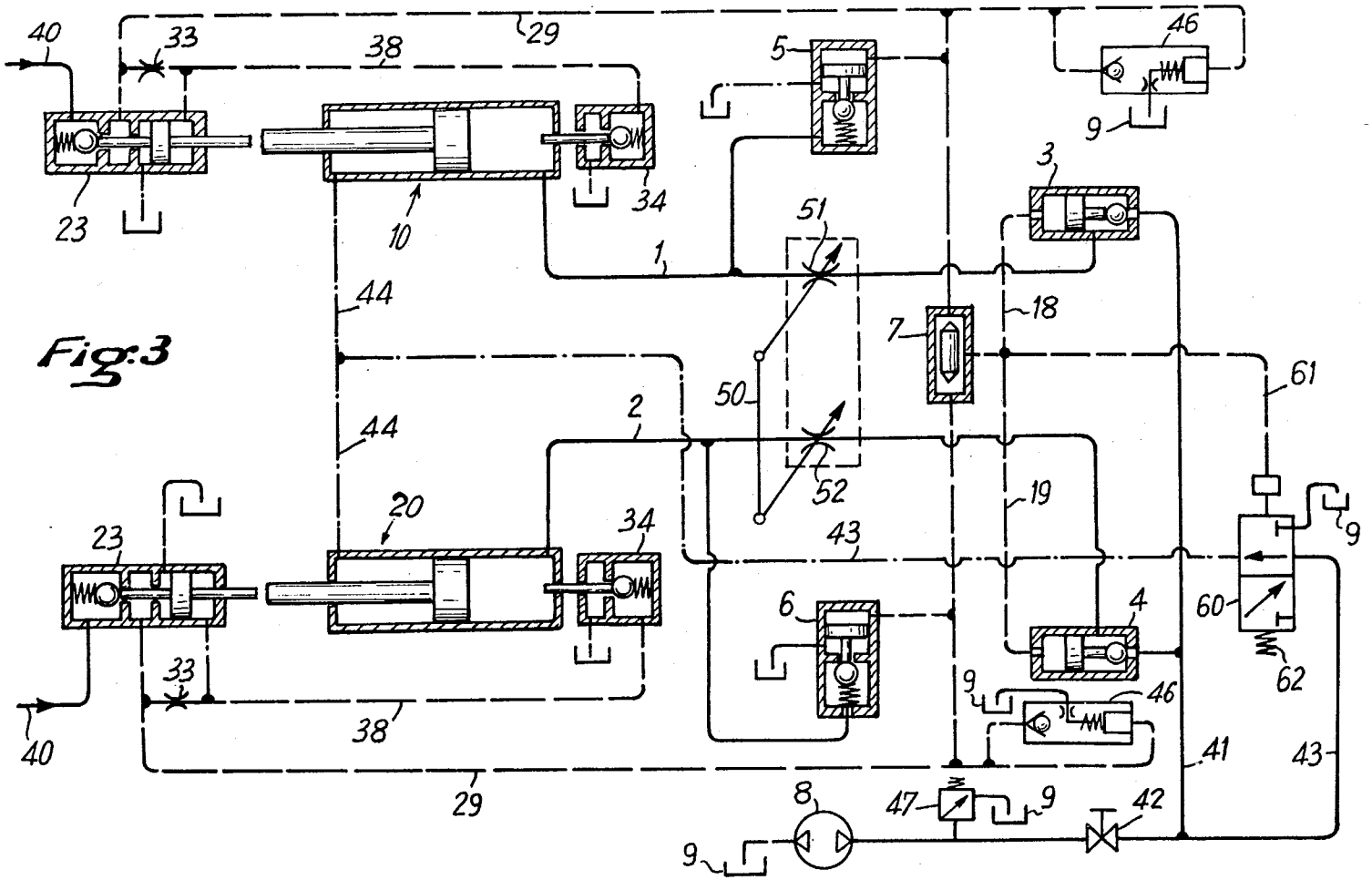
FIG. 3 is a variant of the diagram of FIG. 1.

FIG. 3 illustrates a variant of the device of FIG. 1, wherein the resetting chambers are not supplied permanently, but are supplied by the pilot device solely when it is in the active pilot position. The constituent elements of the device of FIG. 1 are similarly referenced in FIG. 3. The installation differs, essentially, in that a three-way distributor 60 is interposed in the pipe 43, which distributor permits the supply of pressurised hydraulic fluid to the resetting chambers only when one of the pilot devices is in its active state. To this end the distributor 60 is piloted through an intermediate pipe 61 connected from the pipes 18 and 19. When the selector 7, or the selectors if there are more than two jacks, no longer supplies fluid under pressure, a spring 62 revents the resetting chambers of the jacks, which permits them to be thrust without hydraulic counterpressure.

In a modification the throttles 45 of FIG. 1 are replaced in FIG. 3 by locked valve elements 46 permitting an escape to flow normally, but which become locked in the closed position when the flow becomes substantial when the corresponding self-locking piloted valve 23 is placed in the active pilot position.

The functioning of the device is exactly the same as that of FIG. 1, except that the hydraulic action in the direction of thrust is no longer differential.

We claim:

1. A quasi-continuous thrust device, comprising:

a plurality of double-acting jacks, each including:

a cylinder slidably containing a piston having a working face defining with said cylinder a work chamber, and a resetting face defining with said cylinder a resetting chamber;

each piston being reciprocally slidable in the respective cylinder between a starting position in which the work chamber is minimized and an end-of-work stroke position in which the resetting chamber is minimized;

a hydraulic pump;

a plurality of pressurized hydraulic fluid supply pipes normally simultaneously supplied in parallel by said hydraulic pump, each being connected to a respective said working chamber of a respective said jack, so that each is normally supplied in parallel by said hydraulic pump;

controlled closure means for closing the respective supply pipes;

controlled venting means for venting the respective work chambers;

a respective bi-stable self-lock pilot device associated with each said jack, each including means for tripping the respective bi-stable self-lock pilot device to an active pilot position upon arrival of said piston of the respective jack at said end-of-work stroke position thereof;

a respective unlocking device associated with each said jack, operable upon return of said piston of the respective jack at said starting position thereof to unlock the respective bi-stable self-lock pilot device;

control means responsive to a respective bi-stable self-lock pilot device being in said active pilot position thereof, to control both said controlled venting means of the respective jack and the closure of said controlled closure means for the respective supply pipe;

respective pressurized hydraulic fluid supply means for each said resetting chamber, being operable at least when the respective bi-stable self-lock pilot device is in said active position thereof; and additional closure means for isolating said work chambers by at least one circuit selector in response to any one of said self-lock pilot devices being placed in said active position thereof.

2. A device according to claim 1, wherein each jack is a differential jack, the work face of the piston of which is of greater area than its resetting face, and each resetting chamber is permanently supplied by the associated pressurised hydraulic fluid supply means.

3. A device according to claim 1, wherein pressurised hydraulic fluid supply means for each resetting chamber is responsive to the active pilot position of the associated bistable pilot device.

4. A device according to claim 1, or claim 2, wherein the bistable pilot device is a self-locking piloted valve controlled by a push-rod which is operable by the end-of-work stroke position of the jack piston.

5. A device according to claim 1, wherein the device which is operable on the return of the piston into its starting position is a simple piloted valve controlled by a push-rod operable by the return of the piston into its starting position and which controls the venting of the locking circuit of the bistable pilot device.

* * * * *